United States Patent [19]

Hill

[11] 4,040,545

[45] Aug. 9, 1977

[54] CLOTHING HANGER GUARD

[75] Inventor: Andrew Joseph Hill, Long Beach, Calif.

[73] Assignee: The Raymond Lee Organization, Inc., New York, N.Y. ; a part interest

[21] Appl. No.: 593,655

[22] Filed: July 7, 1975

[51] Int. Cl.[2] ..... A47J 51/098

[52] U.S. Cl. ..... 223/85

[58] Field of Search ..... 223/85, 88, 92, 93, 223/94, 98; 211/113, 119, 340; 224/45 T, 45 W; 16/110 R, 116 R, 120

[56] References Cited

U.S. PATENT DOCUMENTS

| | | | |
|---|---|---|---|
| 1,429,835 | 9/1922 | Biener | 223/88 |
| 2,355,705 | 8/1944 | Cohn | 223/85 X |
| 2,637,472 | 5/1953 | Lyons | 223/92 |
| 3,112,050 | 11/1963 | Eason | 223/85 X |
| 3,633,801 | 1/1972 | Bonasso | 224/45 T |
| 3,702,166 | 11/1972 | Jaffe | 223/85 |

FOREIGN PATENT DOCUMENTS

| | | | |
|---|---|---|---|
| 1,252,208 | 12/1960 | France | 223/88 |
| 916,481 | 1/1963 | United Kingdom | 223/88 |

*Primary Examiner*—George H. Krizmanich
*Attorney, Agent, or Firm*—Howard I. Podell

[57] ABSTRACT

A wire clothing hanger which is adaptable for the carrying of heavy clothing, in which the hook section of the hanger is enclosed in a protector member of increased outer diameter than the wire of the hook itself.

The protector member is preferably fabricated of a soft material such as foam rubber or foam plastic, or of a paper pulp product so as to prevent injury to the hand of a person carrying such a hanger by the hook section, when heavy clothing is wrapped about the hanger.

1 Claim, 4 Drawing Figures

CLOTHING HANGER GUARD

SUMMARY OF THE INVENTION

This invention relates to a wire hanger for clothing, and particularly to a hanger, the hook section of which is protected by a guard to permit the carrying of such hanger and attached clothing, without injury to the hand of the person holding the hanger by the hook section.

The advantage of this device is that the hanger may be readily hand held, and particularly when heavy clothing is fastened about such hanger.

The hanger of this invention is of the conventional size and shape of a wire clothing hanger customarily used by laundries, cleaning establishments, tailors and stores to hand the finished clothing of men and women. In carrying the clothing from such establishments, the customers are accustomed to hold the hanger by the hook member of the hanger. The hanger of this invention protects the hand of the person holding the hanger hook section, by enclosing the hook section of the hanger in soft material such as foam rubber, foam plastic, or paper pulp products, so as to increase the effective diameter and bearing surface of the hook section.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
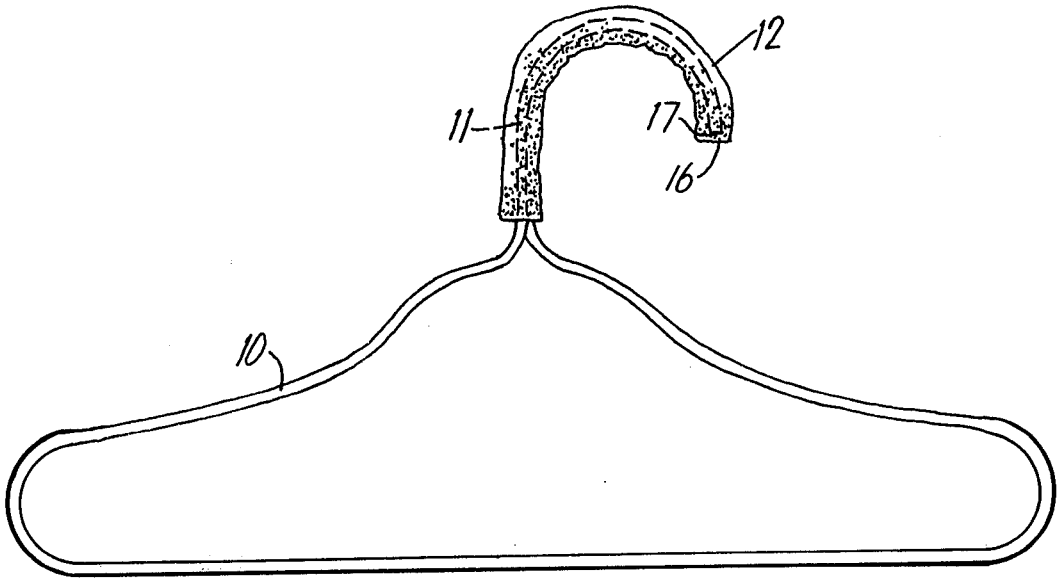
FIG. 1 is an elevation view of the hanger.
Figure 2:
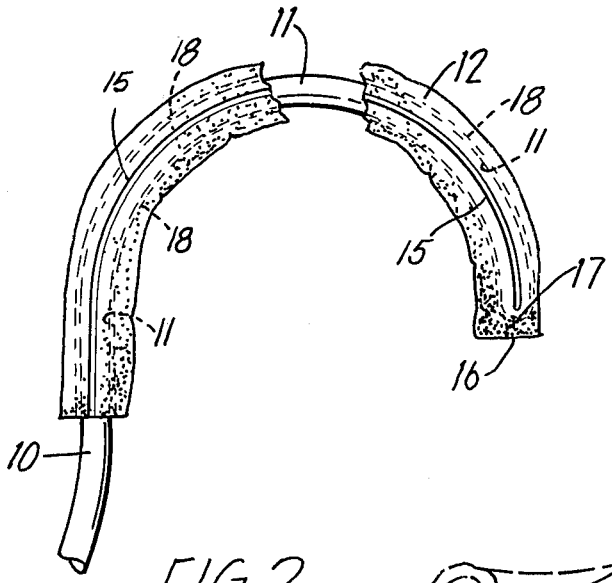
FIG. 2 is a fragmentary elevation view of the hook section of the hanger.
Figure 3:
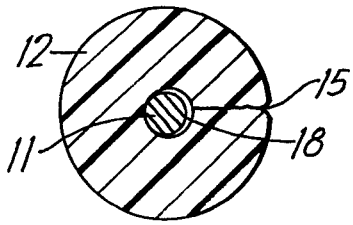
FIG. 3 is a sectional view of the hook section of the hanger.

Turning now descriptively to the drawings, in which similar reference characters denote similar elements throughout the several views, FIGS. 1–3 illustrate a wire hanger 10 of conventional shape with a hook section 11 which is employed to hang the hanger over a horizontal rod, or is grasped when carrying the hanger 10.

The hook section 11 is enclosed by a protector guard member 12 which increases the external diameter and bearing area of the hook section 11 so as to distribute the holding load and to reduce the unit bearing stress.

Protector guard member 12 may be formed of a soft material such as foam rubber, or foam plastic, or may be fabricated of a paper pulp product of a varying degree of hardness, but with a greater resiliency than the stiff wire of the hook section 11.

Figure 4:
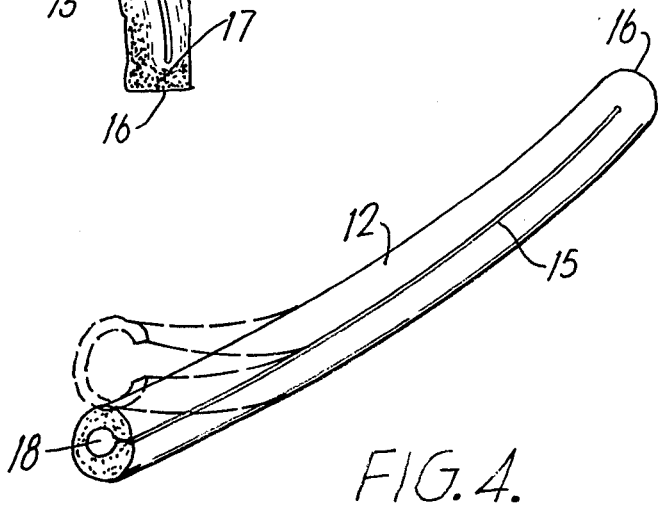
FIG. 4 is a perspective view of the protector member, prior to installation on the hook section of a hanger.

As shown in FIGS. 3–4, the protector guard 12 may be formed of a section of plastic or paper tubing about an axial hole 18 which is of the general diameter of the wire of the hanger 10. The axial hole 18 of guard 12 may be closed at one end to form a solid tip 16. The protector 12 may be thus slid over the free end of the hook section 11 in installing the protector guard 12 on the hanger 10, with the solid tip 16 of the protector coming to rest against the end 17 of the wire of the hook section 11 of the hanger 10. In this fashion, the end 17 of the hook section 11 is guarded so as to prevent injury to persons carrying the hanger, or to upholstery, furniture or other materials upon which the hanger 10 may brush, while the hanger is being transported.

A slit 15 may be located along the length of the protector 12, said slit 15 extending from the outer circumference to the inner circumference of the tubular section of the protector guard. Such a slit 15 permits the guard to be readily installed on the hook section 11 of a hanger. Preferably the slit 15 does not extend to the tip 16 of the protector so as to permit the tip to be of a solid section for purposes of protection.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A clothing hanger shaped for the support of articles of clothing which may be hung from said hanger, including a curved hook section of the hanger which is shaped so as to support the hanger and any clothing attached on the hanger when the hook section is grasped or fixed, together with a protector member detachably mounted about the curved wire of the hook section of the hanger, said protector member serving to reduce the lifting stress, applied in bearing, to the hook section of the hanger, when the hanger is held from the hook section, said protector member being a tube of circular cross-section of a larger outer diameter than the wire of the hook section of the hanger, in which the protector is fabricated of a tube of flexible plastic material which is softer than the wire of the hook section of the hanger, said tube slitted along its length, in which the protector member is formed of a hollow tube closed at one end of the tube to form a closed tip at said end, with the slit of the tube terminating short of the said closed tip.

* * * * *